United States Patent [19]

Long

[11] 3,935,959

[45] Feb. 3, 1976

[54] CONTAINER FOR BULK TOBACCO

[75] Inventor: William R. Long, Tarboro, N.C.

[73] Assignee: Long Mfg. N. C., Inc., Tarboro, N.C.

[22] Filed: Jan. 31, 1975

[21] Appl. No.: 546,167

[52] U.S. Cl. ..... 220/22; 34/237; 56/27.5; 214/5.5; 294/5.5; 432/500

[51] Int. Cl.[2] ..... A24B 1/06

[58] Field of Search ..... 432/500; 131/134; 220/22; 294/5.5; 34/237, 238; 47/28, 29, 30, 31; 214/5.5; 56/27.5

[56] References Cited

UNITED STATES PATENTS

| | | | |
|---|---|---|---|
| 1,824,928 | 9/1931 | Pritchard | 34/238 |
| 3,109,637 | 11/1963 | Taylor | 432/500 |
| 3,134,583 | 5/1964 | Wilson | 294/5.5 |
| 3,244,445 | 4/1966 | Wilson | 294/5.5 |
| 3,250,405 | 5/1966 | Rosser | 214/5.5 |
| 3,659,889 | 5/1972 | Whitley | 214/5.5 |
| 3,834,137 | 9/1974 | Long | 56/27.5 |

*Primary Examiner*—William Price
*Assistant Examiner*—Joseph M. Moy
*Attorney, Agent, or Firm*—Dowell & Dowell

[57] ABSTRACT

An apparatus for receiving a large quantity of green tobacco leaves in bulk form with an intermediate screen separating portions of the leaves along the entire length of the container and with a plurality of independent support rods for supporting the tobacco leaves in generally vertical position while the leaves are being cured. The tobacco container is open at one side only during filling and is open at the top and bottom only during the curing process.

15 Claims, 8 Drawing Figures

CONTAINER FOR BULK TOBACCO

BACKGROUND OF THE INVENTION

1. Field of the Invention

This invention relates generally to apparatus for processing and curing tobacco leaves and relates particularly to a container which receives a large quantity of randomly oriented green tobacco leaves after which the leaves are secured in position and the container is placed in a tobacco barn for curing the tobacco.

2. Description of the Prior Art

In the past tobacco leaves originally were picked manually and a group of the leaves or a hand were oriented so that the stems were together and the leaves were all disposed in the same direction, after which the stems were lashed together and were hung over a tobacco stick. Subsequently a plurality of rows and columns of sticks were placed in a tobacco barn where they were treated by heat to cure the green tobacco leaves.

In order to reduce the tedious drudgery of tobacco harvesting and curing, tabacco harvesters were developed such as shown by the patents to Long U.S. Pat. Nos. 2,952,370 and 3,215,288 which transport workmen through a tobacco field so that such workmen can prime the tobacco plants manually and convey the leaves upwardly to a platform where other workmen orient the leaves and place the leaves on sticks for curing. In recent years several agricultural colleges and universities have conducted extensive experiments on the bulk curing of tobacco which included tobacco racks that received randomly oriented leaves and after the racks were filled such leaves were fixed in position by pin frames having a plurality of elongated slender rods to hold the tobacco leaves in position when the racks were rotated approximately 90° when placed in a tobacco barn so that warm air could flow upwardly through the tobacco leaves for curing the same. These bulk tobacco racks had a width less than the length of a mature tobacco leaf and were of a size to receive approximately 100 to 150 pounds of green tobacco leaves so that one or two workmen could place the racks in two or three vertically spaced tiers within a barn for curing the leaves.

Some effort has been made to provide a harvester for automatically defoliating some of the leaves of a tobacco plant within a predetermined range above the ground. Some examples of this type of tobacco harvester are the patents to Wilson U.S. Pat. Nos. 2,816,416, 2,834,173 and 3,083,517; Suggs et al. U.S. Pat. No. 2,834,174; Splinter U.S. Pat. No. 3,093,949; Pickett et al. U.S. Pat. No. 3,507,106; and Alphen et al. U.S. Pat. No. 3,695,014.

With the advent of the automatic defoliating tobacco harvester, additional efforts were made to advance the art of handling the tobacco leaves by providing larger racks which could accommodate a substantially increased capacity and which could utilize power equipment such as an overhead hoist for placing the racks within a barn for curing. An example of this type of apparauts is disclosed in the Long U.S. Pat. No. 3,834,137. This structure improved the bulk tobacco rack situation by providing an elongated rack which formed a column of leaves through which warm air passed to cure the leaves.

In the curing of tobacco leaves in large containers or racks, it is especially important to insure the proper airflow throughout the entire curing cycle. When the warm air moves upwardly through the column of leaves, the lowermost leaves cure first by giving up their water content which permits the air to move upwardly through the leaves more easily and progressively cure the upper leaves. However, the drying and shrinking of the lower leaves sometimes tends to open a passage for air through the side of the rack so that the air passes between adjacent racks with the result that some of the upper leaves are not fully treated. Additionally, as the leaves dry and give up their moisture, such leaves have a tendency to bend over or flop as space becomes available due to the shrinkage with the result that the bent leaves block the passage of air so that the air cannot pass through the upper leaves to cure the same.

SUMMARY OF THE INVENTION

The present invention is embodied in a bulk tobacco rack or container of a large size which is capable of accommodating up to approximately 4,000 pounds of green tobacco and which can be easily and quickly filled with randomly oriented tobacco leaves through an open side of the container. After the container is filled, the open side is closed and the leaves are pinned in position by a plurality of slender rods passing through one side and extending to the other side, and the rack is rotated substantially 90° to form an enclosed hollow tubular column which prevents the escape of air through the sides. In the filling position the container is open at one side only and in the curing position the top and bottom only of the container are open to permit passage of warm drying air through the tobacco leaves. The container is substantially wider than normal and at least one perforate partition or divider is provided to prevent the leaves from flopping over and attaining an attitude which would block the passage of air therethrough.

It is an object of the invention to provide a container for bulk tobacco which holds a large quantity of randomly oriented leaves and such container is open at one side only during the filling process and is open at the top and bottom only during the curing process.

Another object of the invention is to provide a large rectangular tubular container having at least one perforate partition to maintain the tobacco leaves in a generally vertical plane.

DESCRIPTION OF THE PREFERRED EMBODIMENT

Figure 1:
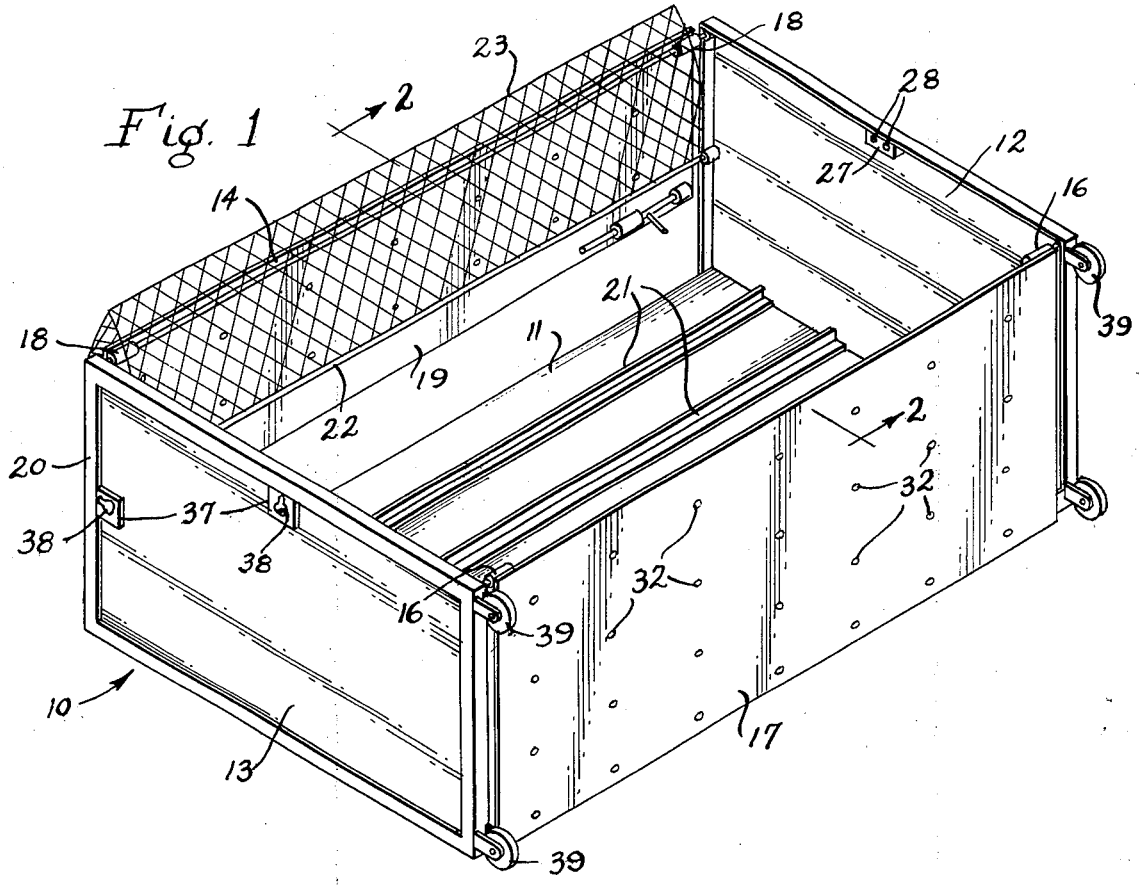
FIG. 1 is a perspective illustrating the bulk tobacco container in position for receiving tobacco leaves.

With continued reference to the drawings, a bulk tobacco curing container 10 is provided having an imperforate wall 11 connected to a pair of imperforate end walls 12 and 13 disposed at right angles thereto. The corners of the end walls 12 and 13 remote from the side wall 11 are connected to each other by braces 14 and 15 to form a substantially rigid structure. The lower brace 15 rotatably supports one or more sleeves 16 which are welded or otherwise attached to a lower side panel 17. The upper brace 14 rotatably supports one or more sleeves 18 which are welded or otherwise attached to an upper side panel 19.

Although the walls of the container may be of any desired size, it is preferred that the side wall 11 be approximately 9 feet 6 inches long and 6 feet wide, while each of the end walls 12 and 13 is approximately 6 feet long by 3 feet 6 inches wide. The lower side panel 17 is of a length ot substantially fill the space between the end walls 12 and 13 and is approximately 3 feet 6 inches wide while the upper side panel 19 is of a length corresponding to the length of the lower side panel and is substantially 2 feet 6 inches wide. The side wall, the end walls and the side panels all are constructed of sheet material such as galvanized ferrous metal such as sheet steel or may be constructed of sheet aluminum or the like.

A reinforcing frame 20 is provided for supporting and rigidifying the walls of the container. A plurality of angle members 21 are provided which extend substantially the full length of the side wall 11 and such angle members have a first web which is welded or otherwise attached to the side wall 11 and a second web which extends outwardly substantially at right angles for a purpose which will be described later.

A cross rod 22 is located generally centrally of the upper edge of each of the end walls 12 and 13 and a perforate screen or divider 23 is mounted on such rod. If desired the cross rod 22 may be fixed to the end walls 12 and 13 and the screen 23 can be swingably connected to the rod, or the screen 23 may be fixed to the rod and the rod swingably connected to the end walls 12 and 13. Preferably the screen 23 is constructed of heavy duty open mesh material similar to a chain link fence and if desired the lower portion of the screen may be hingedly connected to the upper portion so that the screen may be easily bent intermediate its ends, as illustrated in FIGS. 1 and 2.

Figure 2:
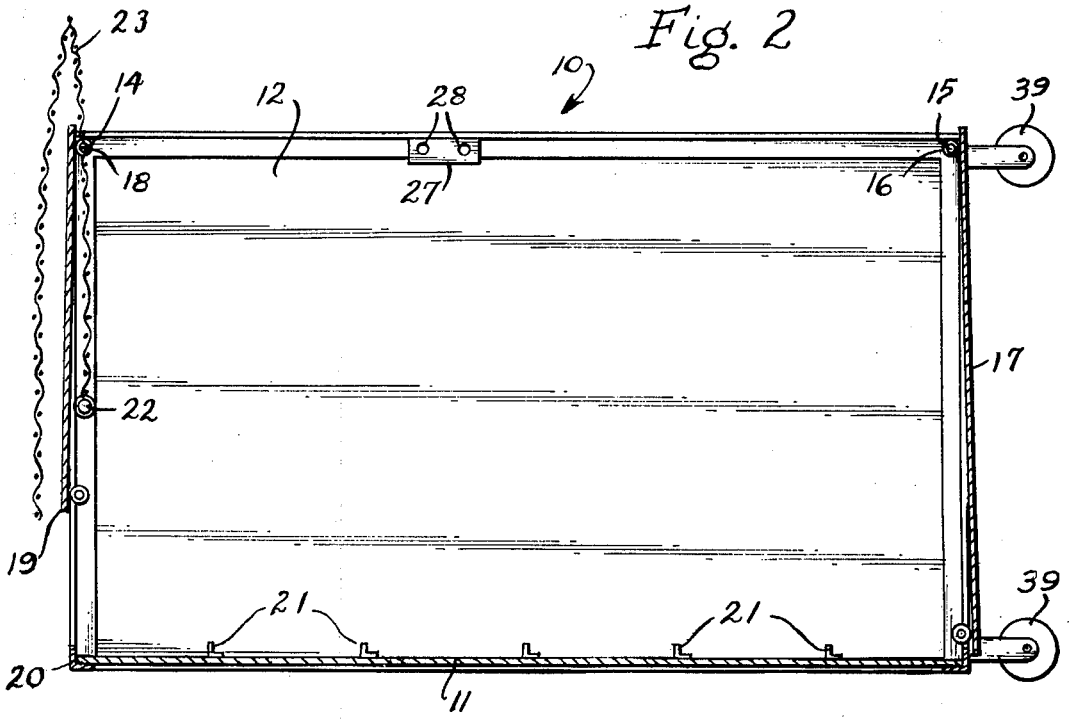
FIG. 2 is an enlarged section on the line 2—2 of FIG. 1.
Figure 3:
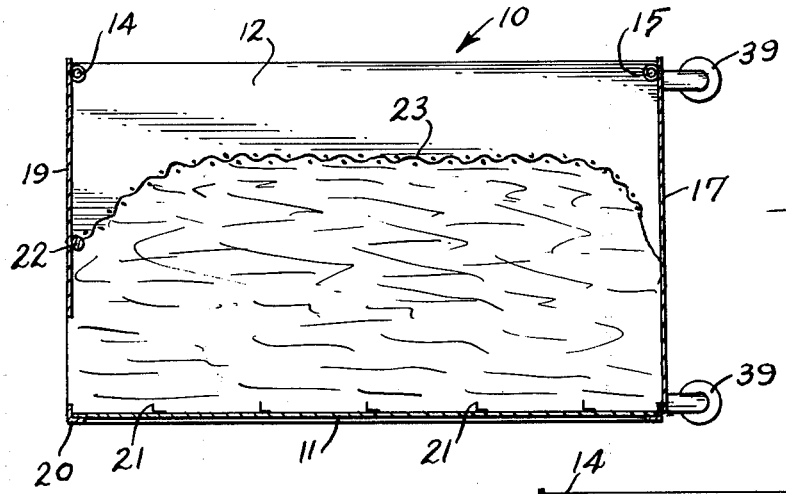
FIG. 3 is a section similar to FIG. 2 at a reduced scale illustrating the container partially filled.
Figure 4:
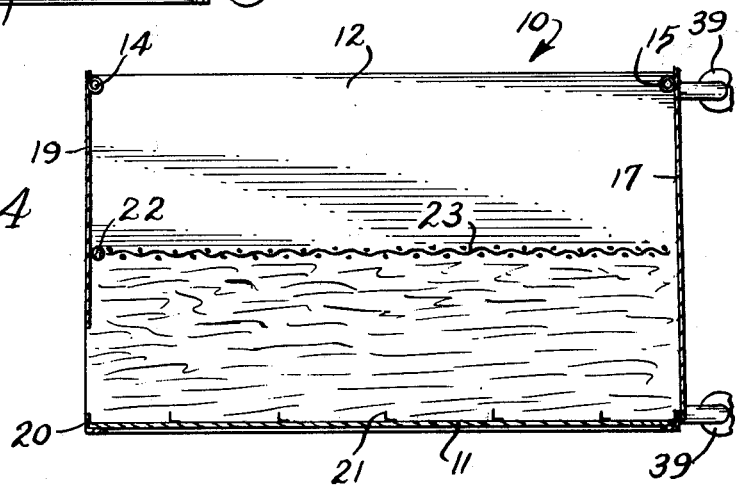
FIG. 4 is a section similar to FIG. 3 after the first charge of material has been compacted.
Figure 5:
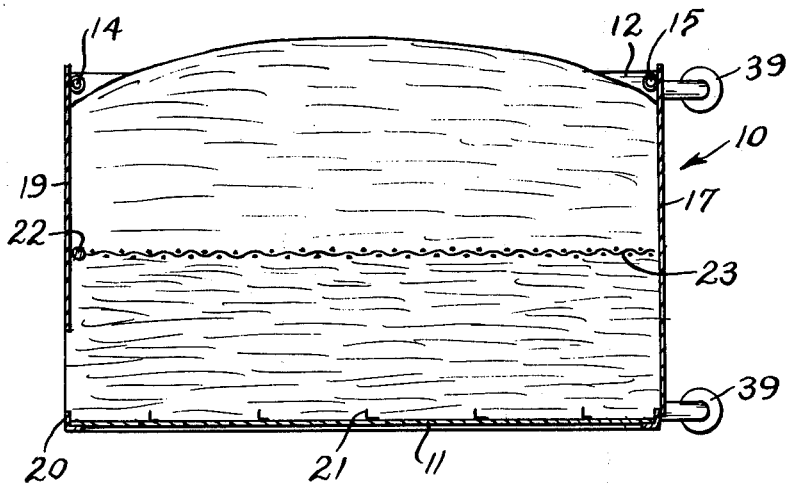
FIG. 5 is a section similar to FIG. 4 illustrating the container substantially completely filled but with the side still open.
Figure 6:
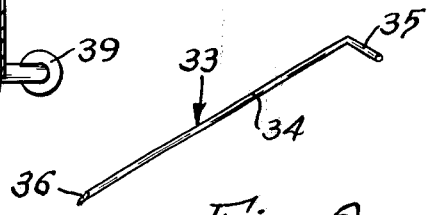
FIG. 6 is a perspective of one of the tobacco pins.

When an initial charge of material is being placed in the container, the screen 23 is moved to a position in which most of the screen is located exteriorly of the container, as illustrated in FIGS. 1 and 2. When the container is partially filled, the screen 23 is swung to a position within the container and overlying the initial charge of tobacco leaves, as illustrated in FIG. 3. When the screen is in this position, the tobacco leaves are compacted in any desired manner, as by one or more persons walking on the screen until the screen is substantially parallel with the side wall 11, as illustrated in FIG. 4. Thereafter a second charge of green tobacco leaves are piled on top of the screen 23, as illustrated in FIG. 5.

With particular reference to FIGS. 1–5, the side panels 17 and 19 are swung about the braces 14 and 15 so that the lower side panel closes the open bottom of the container while the upper side panel 19 substantially closes the open upper portion of the container while the container is being filled. In practice, the container normally is filled while the container is being carried by a wagon or other vehicle (not shown) and such wagon may have an upstanding baffle board which is substantially coextensive with the upper side panel 19 and closes the top of the container.

After the container has been filled, the side panels 17 and 19 are rotated approximately 270° about the lower and upper braces 15 and 14, respectively, so that such panels are substantially in alignment with the edges closely adjacent to each other and close the open side of the container. In order to lock the side panels in this position, each of the corners of the lower and upper panels remote from the braces is provided with a latching mechanism such as a slide pin 24 which is slidably mounted within a pair of spaced sleeves 25 and such slide pin is adapted to be moved axially by a handle 26. A socket member 27 is mounted on each of the end walls 11 and 12 and such socket member has a pair of spaced openings 28 of a size to receive the outer ends of the slide pins 24.

Figure 7:
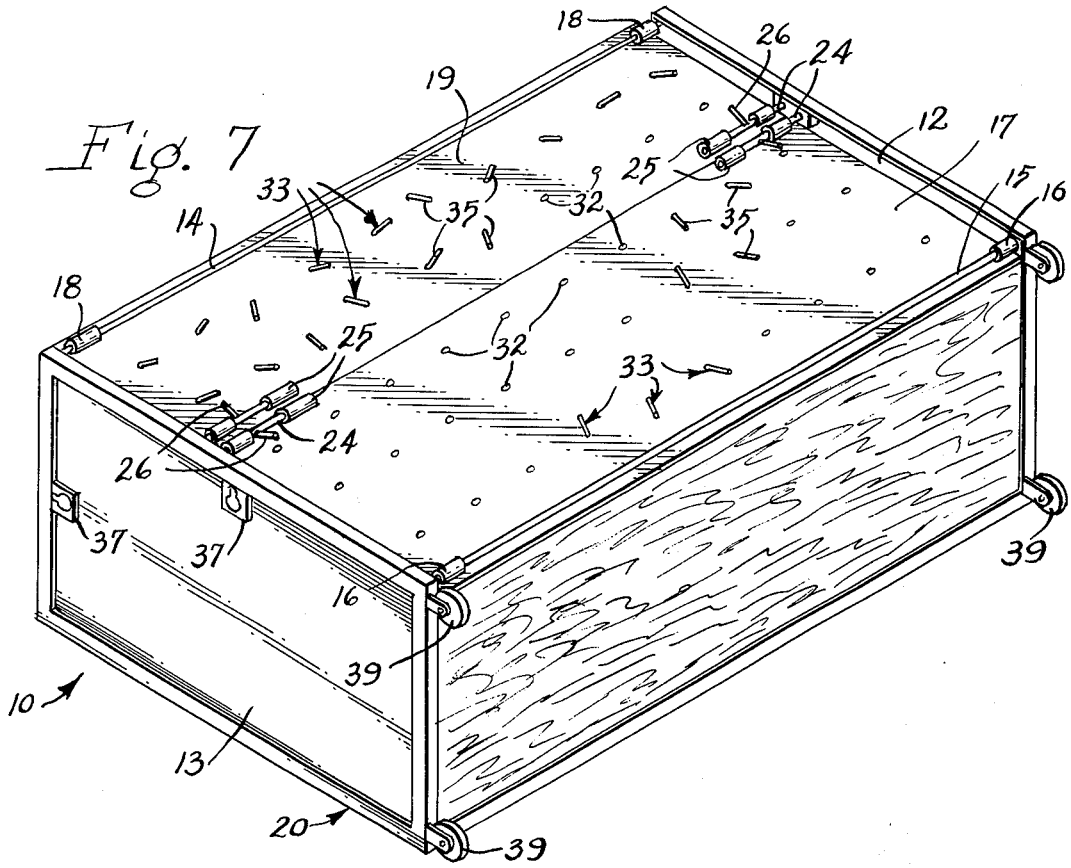
FIG. 7 is a perspective similar to FIG. 1 in which the container has been filled and the side of the container has been closed.
Figure 8:
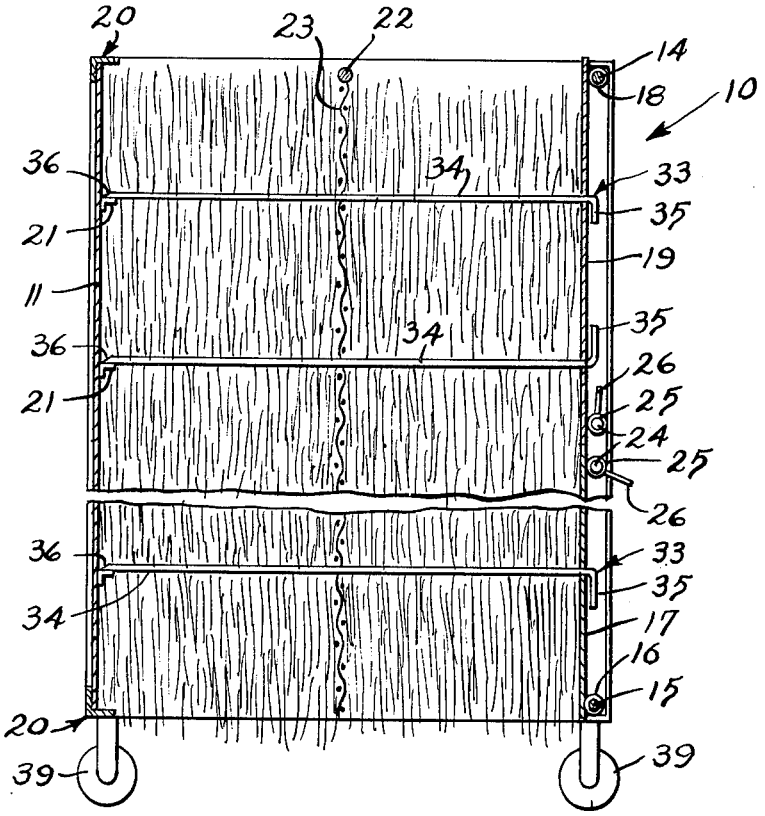
FIG. 8 is an enlarged fragmentary section of a filled container which has been rotated to a position for curing the tobacco leaves.

With particular reference to FIGS. 1 and 7, each of the side panels 17 and 19 is provided with a plurality of rows and columns of openings 32 arranged in such a manner that each row of openings is substantially opposite one of the angle members 21 carried by the side wall 11 when the side panels are in the position shown in FIG. 7. In this position a plurality of pins 33 are provided for holding the leaves of tobacco in fixed position within the container. Each of the pins 33 includes an elongated slender substantially straight body 34 having an operating handle 35 at one end and a penetrating portion 36 at the opposite end. The pins are of a size to pass through the openings 32 in the side panels and pass through the tobacco leaves and the screen 23 and terminate adjacent to and above the angle members 21 on the side wall 11 so that the pins support the weight of the green tobacco leaves when the container is rotated to an upright position. In the upright position the inner ends of the pins rest on the angle members 21 while the intermediate portions of the body 34 of the pins are supported by the screen 23 to prevent the pins from sagging under the weight of the tobacco leaves.

In order to handle the container with power lift equipment, each of the end walls 12 and 13 is provided with a pair of bosses 37 having hook or pin receiving openings or keyholes 38 for receiving the bridle of the power lift equipment. One of the bosses 37 of each of the end walls is located generally centrally of the edge adjacent to the side panels 17 and 19 so that the container can be lifted from the wagon or other supporting vehicle (not shown). The other boss is located generally centrally of the top of each end wall so that the power lift connecting member can be inserted in the openings for rotating the container substantially 90° to an upright position for insertion into a bulk tobacco barn. In order to assist in inserting the containers into the barn, the bottom of each of the end walls 11 and 12 is provided with a pair of spaced rotatably mounted wheels 39 for rolling the container along a floor or track into the barn.

In the operation of the device, the container 10 is placed on a supporting surface, such as a wagon or the like, with the side wall 11 resting on the supporting surface and with the side panels 17 and 19 being rotated outwardly to substantially close the top and bottom of the container. As illustrated in FIG. 1, when the container is in this position, the side wall 11 functions as a bottom and the end walls 12 and 13 and the side panels 17 and 19 provide generally vertical walls so that the container is open at the top only. Tobacco leaves which are harvested in the field are discharged randomly into the container with all of the leaves being substantially flat and with the stems of the leaves disposed in a multiplicity of directions. Preferably one or more workmen spread the first batch of leaves throughout the container and kept substantially level as the leaves are being discharged thereinto until the leaves reach a height substantially above the central horizontal plane of the container.

At this point the introduction of tobacco leaves into the container is interrupted and the screen 23 is rotated to a position overlying the batch of leaves. One or more workmen compress the batch in any desired manner, as by walking on the screen 23 until the entire screen is substantially parallel with the side wall 11, as illustrated in FIG. 4. Thereafter another batch of tobacco leaves are discharged into the container until the leaves are mounded up above the end walls and the braces 14 and 15 and kept substantially level. At this time the container is removed from the wagon and the side panels 17 and 19 are swung to a position overlying the mounted leaves after which the second batch of leaves are compacted until the side panels are substantially parallel with the side wall 11.

The slide pins 24 are moved outwardly into the openings 28 of the socket member 27 to lock the side panels in position. When the side panels are locked, the pins 33 are inserted through the openings 32 in the side panels and such pins are caused to penetrate the tobacco leaves and pass through the screen 23 to a position slightly above the angle members 21. When the pins 33 are in place, the container 10 is rotated substantially 90° onto the wheels 39 and the container is rolled into a bulk tobacco barn. In this position the top and bottom only of the container are open and the leaves of tobacco are supported by the pins 33 which in turn are supported by the angle members 21, screen 23, and the openings 32 in the side panels 17 and 19. If desired, a resilient seal may be provided between adjacent containers so that all of the air within the barn is forced to move upwardly through the hollow rectangular tubular container. While the tobacco leaves are being dried and cured, the screen 23 prevents the leaves from flopping over and blocking the passage of air through the container.

I claim:

1. Container apparatus for receiving and supporting sheet-like articles comprising an elongated side wall, an end wall connected to each end of said side wall, first and second side panels swingably supported by said end walls in spaced relationship with said side wall, said side wall being selectively locatable in a first generally horizontal position and a second generally vertical position, said side panels being selectively located in a first position for closing the top and bottom of the container apparatus and a second position for closing the side of said container apparatus opposite said side wall, said articles being introduced in a randomly oriented manner generally parallel with said side wall when said side wall is in said first generally horizontal position, means for holding said articles in substantially fixed position when said panels are in side closing position, whereby said articles are introduced into said container apparatus in said first generally horizontal position and are retained in the same relative position when said container apparatus is moved to said second generally vertical position.

2. A container for receiving tobacco leaves in a first position while the leaves are being harvested and for holding the leaves in a second position while the leaves are being cured, said container comprising an elongated wall having a plane positioned generally horizontally while the container is being filled thereby providing a bottom wall, a pair of end walls connected to said elongated wall and extending outwardly therefrom, at least one partition selectively mounted within said container, said partition being carried by said end walls and disposed generally parallel with the plane of said elongated wall after a first batch of leaves less than the capacity of the container is introduced into the container in a randomly oriented haphazard manner with at least most of the leaves in generally horizontal planes, said partition substantially covering the first batch of leaves so that a second batch of leaves subsequently may be placed on said partition in a randomly oriented haphazard manner, and pin means engageable with said partition and extending through said first and second batches of leaves to hold the tobacco leaves within the container in fixed position, whereby when said container is filled it is rotated so that the plane of said elongated wall is positioned generally vertically thereby providing a side wall, said partition supports said pin means and said pin means supports the weight of the leaves while said partition maintains the leaves in position along generally vertical planes as the leaves are being cured by air passing therethrough.

3. A container for receiving and treating bulk tobacco leaves comprising an elongated imperforate side wall having an imperforate end wall connected to each end thereof, a first side panel swingably supported on said end walls in spaced relationship to said imperforate side wall, a second side panel swingably supported on said end walls in spaced relationship with said imperforate side wall, said first and second side panels being movable to first positions substantially coextensive with each other and generally parallel with said imperforate side wall to provide a substantially hollow container which is open at the top and bottom, said first and second side panels being swingable to second positions to substantially close the top and bottom of the container and to open the side thereof for receiving bulk tobacco leaves with randomly oriented stems, each of said first and second side panels having a plurality of openings, and a plurality of independent pin means of a size to be inserted through the openings in said first and second panels to hold the tobacco leaves within the container in fixed position.

4. The structure of claim 3 including lock means for securing said first and second panels in coextensive position to form one side of the container.

5. The structure of claim 3 including flexible screen means located within said container to divide the tobacco leaves therein.

6. The structure of claim 5 in which said flexible screen means is swingably supported by said end walls and movable from a position extending outwardly of said container to a position generally centrally thereof.

7. The structure of claim 5 in which said screen means is perforated to permit said pins to pass therethrough in a manner that the screen means supports the intermediate portion of said pin means.

8. The structure of claim 3 in which each of said pin means is of a length to extend through said first and second panels and entirely through the tobacco leaves contained therein to a position adjacent to said imperforate side wall, and support means on said imperforate side wall for supporting the ends of said pin means when the container is rotated substantially 90° to an upright position.

9. A container for receiving and treating bulk tobacco leaves comprising an elongated side wall having an end wall connected to each end thereof, a first side panel swingably supported on said end walls in spaced relationship to said side wall, a second side panel swingably supported on said end walls in spaced relationship with said side wall, said first and second side panels being movable to first positions substantially coextensive with each other and generally parallel with said side wall to provide a substantially hollow container which is open at the top and bottom, said first and second side panels being swingable to second positions to substantially close the top and bottom of the container and to open the side thereof for receiving bulk tobacco leaves with randomly oriented stems, and pin means to be inserted through said first and second panels to hold the tobacco leaves within the container in fixed position.

10. Apparatus for receiving and treating bulk tobacco leaves comprising a container having an elongated imperforate side wall, imperforate end walls connected to opposite ends of said side wall and disposed generally normal thereto, upper and lower brace means connecting said end walls in spaced relationship with said side wall, an upper side panel swingably mounted on said upper brace means, a lower side panel swingably mounted on said lower brace means, said upper and lower side panels being movable to a first position substantially in coextensive abutting relationship and generally parallel with said side wall to provide a substantially hollow container which is open at the top and bottom, means for locking said upper and lower side panels in said first position, said side panels being movable to a second position substantially closing the top and bottom of said container and opening the side thereof for receiving bulk tobacco leaves which are disposed generally parallel with said side wall and have randomly oriented stems, each of said upper and lower side panels having a plurality of openings extending therethrough, a flexible perforate partition having one end swingably supported adjacent the top of said end walls, said partition being movable from a position extending outwardly of said container to a position generally centrally thereof and parallel with said side wall, a plurality of elongated pin means of a length to extend through the openings of said side panels and through the tobacco leaves and said partition and terminating adjacent to said imperforate side wall to hold the tobacco leaves within said container in fixed position when the container is rotated to upright position.

11. A container for receiving tobacco leaves in a first position while the leaves are being harvested and for holding the leaves in a second position while the leaves are being cured, said container comprising an elongated first wall, a pair of end walls having side edges connected to opposite ends of said first wall, an elongated second wall selectively connected to the oppositely disposed side edge of each of said end walls and generally parallel with said first wall, the plane of said first wall being positioned generally horizontally and said second wall being moved out of parallel relationship with said first wall to provide an open top container while the container is being filled, at least one perforate partition, said partition being selectively disposed within said container intermediate said end walls and generally parallel with the plane of said first wall, said partition being placed within said container after a first batch of leaves which is less than the capacity of the container is introduced into the container in a randomly oriented haphazard manner with most of the leaves being disposed in a generally horizontal plane, said partition substantially covering the first batch of leaves so that a second batch of leaves subsequently may be placed on said partition in a randomly oriented haphazard manner, and a plurality of pin means of a size to be inserted through said second wall and through said batches of leaves and said partition to hold the tobacco leaves within the container in fixed position, whereby when said container is filled it is rotated so that the plane of said first wall is positioned generally vertically and said pin means support the weight of the leaves while said partition maintains the leaves in generally vertical planes as the leaves are being cured by air passing therethrough.

12. The structure of claim 11 in which said second wall has a plurality of openings of a size to receive said pin means.

13. The structure of claim 11 including support means on said first wall for supporting one end of said pin means.

14. The structure of claim 10, including means on said elongated wall for engaging said pin means, thereby cooperating in supporting the weight of the leaves.

15. The structure of claim 10 and an elongated second wall selectively connected to said end walls and generally parallel with said first mentioned elongated wall, and means on said first mentioned elongated wall for supporting one end of said pin means, whereby said pin means extend through said elongated second wall and said partition engages said pin support means on said first mentioned elongated wall, to support the leaves.

* * * * *

UNITED STATES PATENT AND TRADEMARK OFFICE

CERTIFICATE OF CORRECTION

PATENT NO. : 3935959

DATED : February 3, 1976

INVENTOR(S) : William R. Long

It is certified that error appears in the above-identified patent and that said Letters Patent are hereby corrected as shown below:

Claim 14 line 1 change "10" to --2--

Claim 15 line 1 change "10" to --2--

Signed and Sealed this

*Twelfth* Day of *February 1980*

[SEAL]

*Attest:*

SIDNEY A. DIAMOND

*Attesting Officer*

*Commissioner of Patents and Trademarks*